US006682378B1

(12) United States Patent
Day

(10) Patent No.: US 6,682,378 B1
(45) Date of Patent: Jan. 27, 2004

(54) PIVOTALLY SUSPENDED, VARIABLE DEPTH, PROPELLER DRIVE FOR BOATS

(76) Inventor: Daniel A. Day, 7456 Lindsay Ave., Orland, CA (US) 95963

( * ) Notice: Subject to any disclaimer, the term of this patent is extended or adjusted under 35 U.S.C. 154(b) by 0 days.

(21) Appl. No.: 10/383,995

(22) Filed: Mar. 6, 2003

(51) Int. Cl.[7] ..... B63H 1/18
(52) U.S. Cl. ..... 440/66; 440/69; 440/54
(58) Field of Search ..... 440/54, 68–70, 440/66

(56) References Cited

U.S. PATENT DOCUMENTS 2,415,183 A * 2/1947 Law

* cited by examiner

*Primary Examiner*—Ed Swinehart
(74) *Attorney, Agent, or Firm*—R. Michael West

(57) ABSTRACT

An inboard propeller drive system for shallow water boats comprising a stern tunnel and a propeller drive shaft sub-assembly. The tunnel protrudes upwardly from the floor of the boat, and has an S-shaped bottom plate immersed in water. The sub-assembly includes a housed drive shaft, a propeller, a cavitation plate, and a steering mechanism. The forward end of the sub-assembly is pivotally mounted on opposing inner walls of the tunnel. A universal joint connects the forward end of the drive shaft to the output shaft of an inboard engine. A control shaft extends from the forward end of the sub-assembly to the exterior of the tunnel. The control shaft may be rotated by a user-controlled actuator to raise and lower the sub-assembly, thereby predetermining the depth of the propeller. Encounters with submerged objects may also cause the sub-assembly to rotate upwardly to prevent propeller damage.

22 Claims, 5 Drawing Sheets

PIVOTALLY SUSPENDED, VARIABLE DEPTH, PROPELLER DRIVE FOR BOATS

BACKGROUND OF THE INVENTION

1. Field of the Invention

The invention relates generally to propeller drive systems for boats which are especially adapted for use in shallow and weed-infested water. More specifically, the invention pertains to a pivotally suspended, variable depth, propeller drive system for boats, employing a stern tunnel within the floor of the boat, housing a propeller drive sub-assembly.

2. Description of the Prior Art

The prior art teaches a variety of different approaches for powering water craft in shallow waters. For example, in U.S. Pat. No. 1,473,832, a tunnel housing a propeller mechanism, is hingeably mounted upon the bottom, stern portion of a boat. When a shoe member, mounted below the tunnel housing, encounters an object, the tunnel housing swings upwardly. RE. 24,451, issued to Daniels, shows a swingable boat propulsion and steering unit, for use in shallow waters. In U.S. Pat. No. 4,089,289, granted to Sauder, a propeller drive assembly, including a pair of universal joints, is pivotally mounted and movable through a vertical plane. U.S. Pat. No. 5,791,954, issued to Johnson, Jr. shows a vertically adjustable propeller and rudder drive. A trimmable marine drive apparatus is disclosed in U.S. Pat. No. 6,482,057, granted to Schoell. A fin assembly for use with power boats, is shown in U.S. Pat. No. 4,088,091. U.S. Pat. No. 3,469,558, granted to Puretic, discloses a marine propulsion unit having a longitudinal tunnel surrounding a hollow tube with a drive shaft passing through.

The need exists, however, for a propeller drive system for a boat, which is selectively adjustable to a predetermined operational depth;

The need further exists for a propeller drive system having a electric actuator system for selectively determining the propeller's operational depth;

The need also exists for a propeller drive system for a boat which dynamically and automatically adjusts under forward motion of the boat, to an optimum operational depth for the propeller;

The need also exists for propeller drive system which is pivotally suspended to avoid damage to the propeller in the event the drive system encounters an underwater object;

The need also exists for a propeller drive system which includes a damper in the safety pivoting mounting system to dampen vertical excursions of the drive system;

The need also exists for a propeller drive system using either an air cooled or a self-contained water cooled inboard engine, to eliminate an engine cooling system which is susceptible to mud and weed clogging.

These and other objects will be described below in the drawings and the detailed description of the preferred embodiment to follow.

SUMMARY OF THE INVENTION

An inboard propeller drive system for shallow draft boats. The system includes a stern tunnel in the floor of the boat and a propeller drive sub-assembly having its forward end pivotally suspended within the stern tunnel. The stern tunnel protrudes upwardly from the boat's floor, and includes side walls, a forward end wall, and an upper cover. The bottom portion of the tunnel has an upwardly and rearwardly inclined bottom plate, having a gradual S-shaped configuration. The rear end portion of the tunnel is open, for rearward discharge of the propeller's wash. A tunnel hood extends rearwardly from the rear end of the stern tunnel.

The propeller drive sub-assembly includes a drive shaft housing. A drive shaft extends entirely through the housing, having a forward end connected to a constant velocity joint and a rearward end upon which a propeller is mounted. A deflector skag is located on the lowermost portion of the drive shaft housing, immediately beneath the propeller. The sub-assembly also includes a cavitation plate mounted to the drive shaft housing, and extending above the propeller. Lastly, a steering mechanism is mounted on the rearmost portion of the cavitation plate. The steering mechanism includes a rudder positioned rearwardly from the propeller, and a lever arm interposed between the rudder support shaft and the steering linkage of the boat.

An intermediate portion of the drive shaft housing passes through an elongated slot in the bottom plate of the stern tunnel. The slot is sized and configured to accommodate upward and downward excursions of the drive shaft housing through a vertical plane.

An inboard air cooled or self-contained water cooled engine is provided forwardly from the forward end wall of the stern tunnel The engine includes a rearwardly directed output shaft which passes through the end wall and interconnects to the universal joint and the drive shaft.

The forward end of the sub-assembly includes a suspension yoke, having a support shaft and a control shaft. Both shafts extend laterally to respective bearings on opposing inner walls of the tunnel, thereby pivotally suspending the sub-assembly within the stern tunnel.

The yoke control shaft passes through its bearing to the exterior of the tunnel. A sprocket is located on the exterior end of the control shaft. A chain has one end encircled around a portion of the sprocket. The other end of the chain is connected to the translatable shaft of an electric screw-drive actuator. When the shaft of the actuator is withdrawn, the sprocket and control shaft are rotated counter-clockwise, raising the propeller. When the shaft of the actuator is extended, gravity rotates the propeller drive sub-assembly downwardly, thereby lowering the propeller. In this manner, with the boat at rest, the depth of the propeller in the water may be may be pre-determined by the user to suit the operational conditions.

Normally, the propeller drive sub-assembly is maintained in a lowered position when the boat is at rest. However, with the boat underway and gaining speed, hydraulic forces from water flowing upwardly through the stern tunnel impress upward forces upon the cavitation plate. The propeller drive subassembly thereby pivots upwardly to an extent determined by the speed of the boat. A limit stop within the tunnel hood prevents the sub-assembly from raising higher than a pre-determined limit.

In the event that the deflector skag encounters either the bottom or an object on the bottom, the upward forces which are generated will pivot the entire sub-assembly upwardly. Once the obstacle has passed, the sub-assembly will pivot downwardly under gravity to its pre-determined depth. A pneumatic or hydraulic damper extends between the sprocket and the tunnel sidewall, to dampen the harshness of vertical excursions of the sub-assembly.

DETAILED DESCRIPTION OF THE PREFERRED EMBODIMENTS

Figure 2:
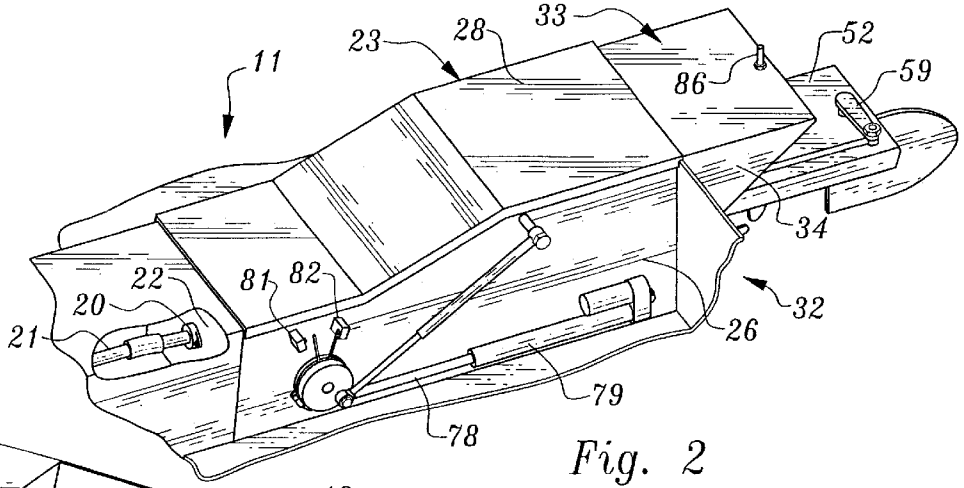
FIG. 2 is a fragmentary, perspective view of the stern tunnel and the rearwardly extending portion of the propeller drive shaft sub-assembly, a section of the drive shaft housing being broken away to reveal the drive shaft.
Figure 1:
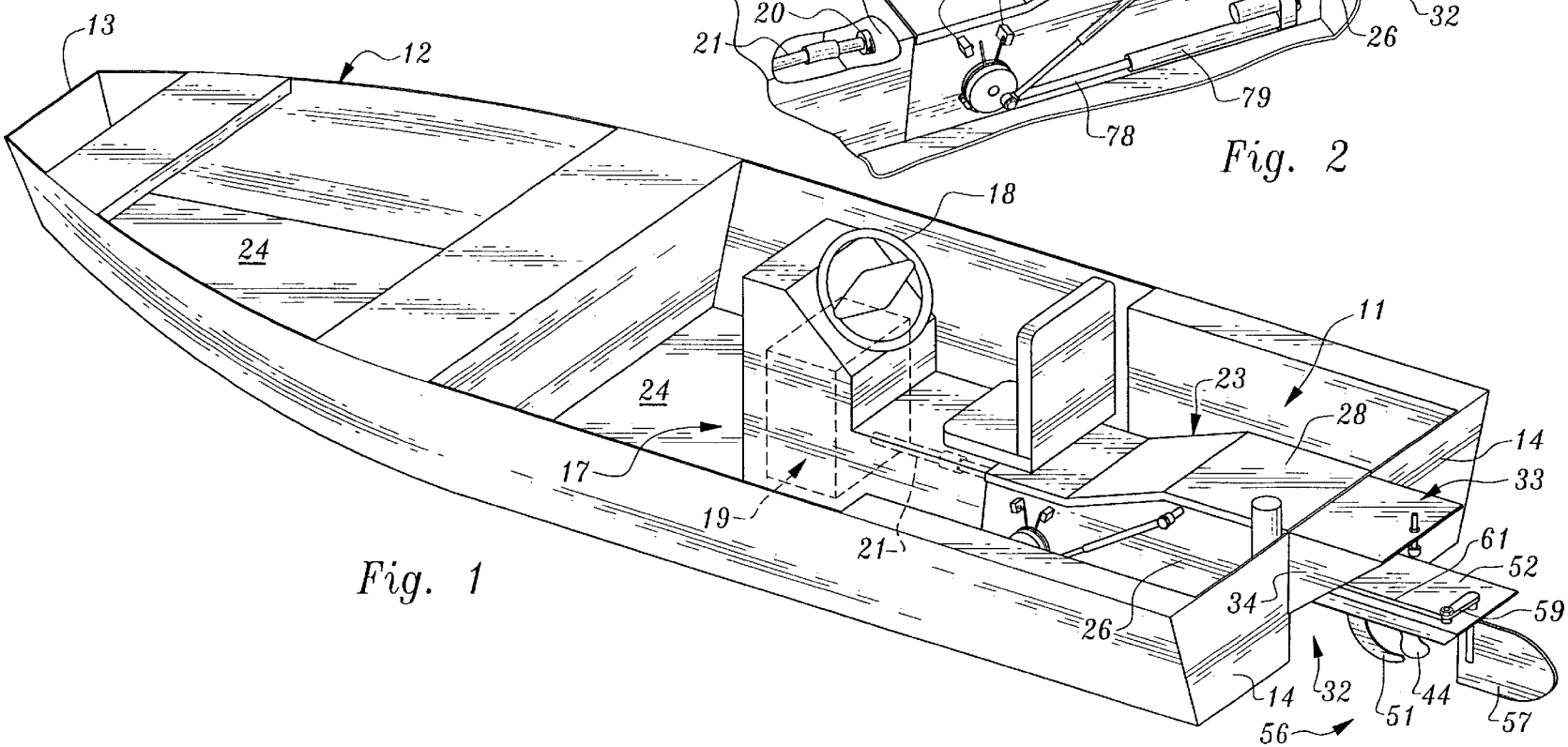
FIG. 1 is a perspective view of a boat fitted with the pivotally suspended, variable depth, propeller drive system present invention.
Figure 3:
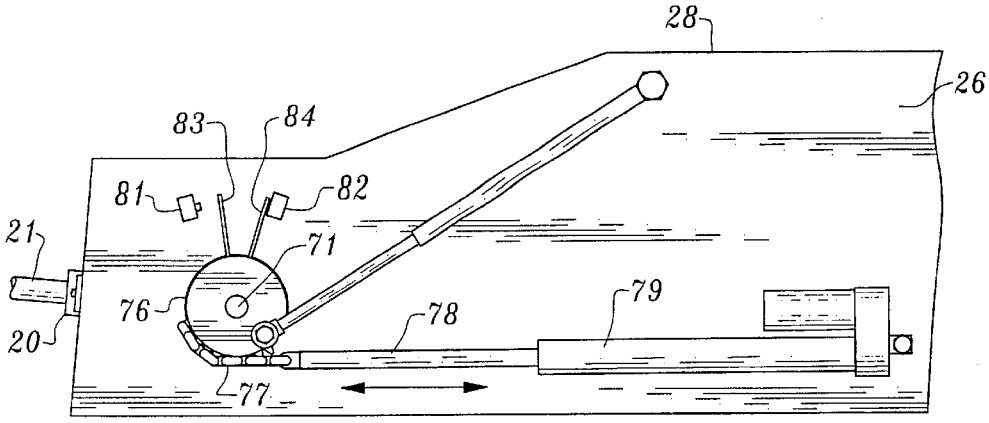
FIG. 3 is a side elevational view of the stern tunnel, showing the sprocket on the exterior end of the control shaft, the screw drive actuator and chain, the damper, and the limit switch assembly.
Figure 4:
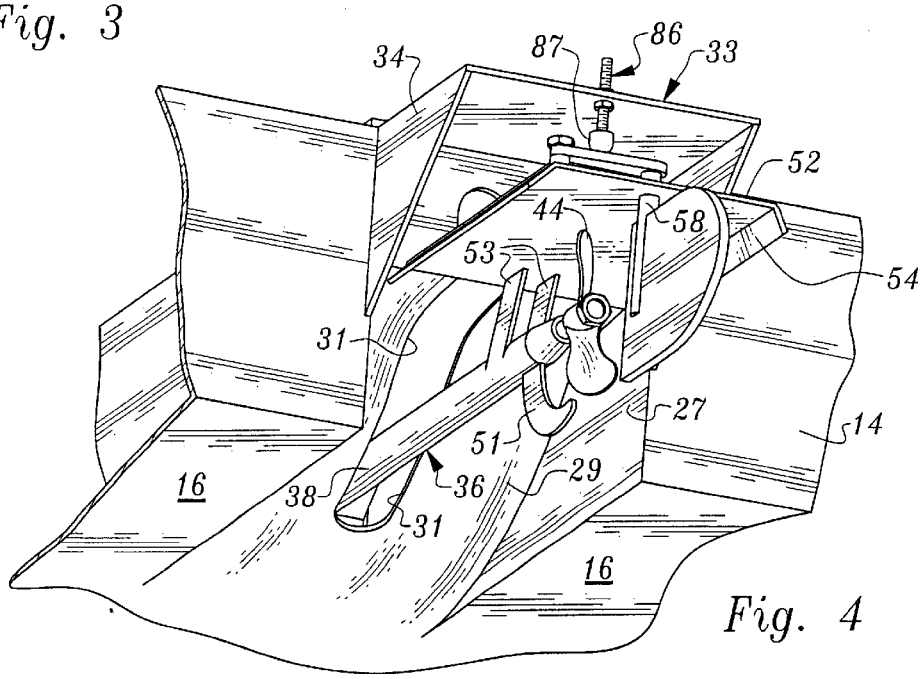
FIG. 4 is a fragmentary, perspective view of the stern of the boat, taken from a low angle, showing the after end of propeller drive shaft sub-assembly in a fully raised position.

Turning now to the drawings, and in particular to FIG. 1, the propeller drive 11 of the present invention is shown installed a boat 12. The boat shown has a squared-offbow 13, a stern 14, and a relatively flat bottom 16. Such features are typical for a hunting, fishing, or exploration boat, adapted for use in shallow or heavily weeded waters. However, the invention is not limited in application to such boats, and may also be used advantageously with boats having differently configured hulls. Boat 12 is provided with a control console 17, supporting a steering wheel 18 and housing an air-cooled or self-contained water cooled engine 19. It is preferred to use either such engine in connection with the invention, as conventional water-cooled engines include external water inlet and cooling plumbing which may become fouled with weeds or clogged with mud.

An engine drive shaft 21 extends rearwardly from engine 19. Drive shaft 21 first passes through a bearing 20 in forward end wall 22. Thereafter, drive shaft 21 continues into the forward, interior portion of an elongated stern tunnel 23. Stem tunnel 23 protrudes upwardly from the floor 24 of the boat 12, with its longitudinal axis generally aligned with the fore and aft axis of the boat. In addition to the forward end wall 22, stern tunnel 23 includes a first side wall 26, an opposing second side wall 27, and an upper cover 28.

Making particular reference to FIGS. 4, 7, 9 and 11, the lower portion of stern tunnel 23 includes a bottom plate 29. The upwardly and rearwardly inclined portion of plate 29 is gradually S-shaped in configuration. An elongated fore and aft slot 31 is provided in the center, rearward portion of bottom plate 29. As shown particularly in FIG. 1, the stern, or rear-end portion 32 of the tunnel is open. A tunnel hood 33, having triangular side plates 34, extends outwardly and rearwardly from the rear end of the stern tunnel.

A propeller drive sub-assembly 36 has a forward end 37 which is pivotally suspended within the stern tunnel 23. The propeller drive sub-assembly 36 includes a fore and aft drive shaft housing 38. A drive shaft 39 extends entirely through the housing 38, having a forward end 41 connected to a universal joint 42, and a rearward end 43 upon which a propeller 44 is mounted.

Figure 5:
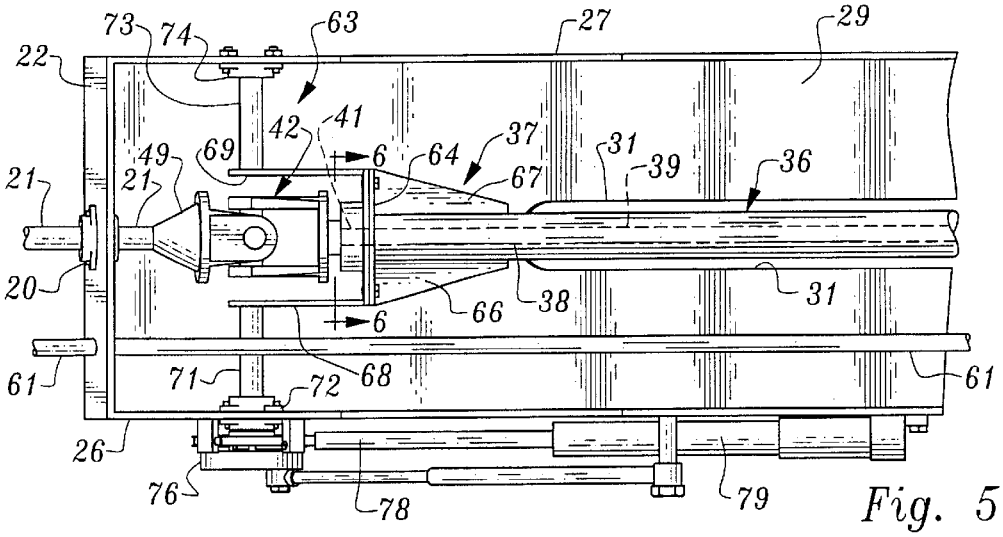
FIG. 5 is a top plan view of the stern tunnel, with the cover removed, showing the forward end of the propeller drive shaft sub-assembly, the drive shaft, and the yoke including laterally extending shafts with respective bearings.
Figure 6:
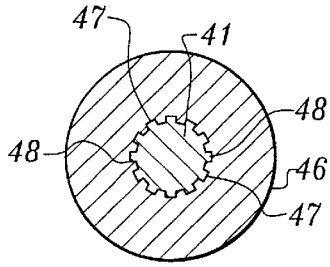
FIG. 6 is a cross-sectional view of the propeller drive shaft, taken on the line 6—6 in FIG. 5, showing the spline detail.
Figure 7:
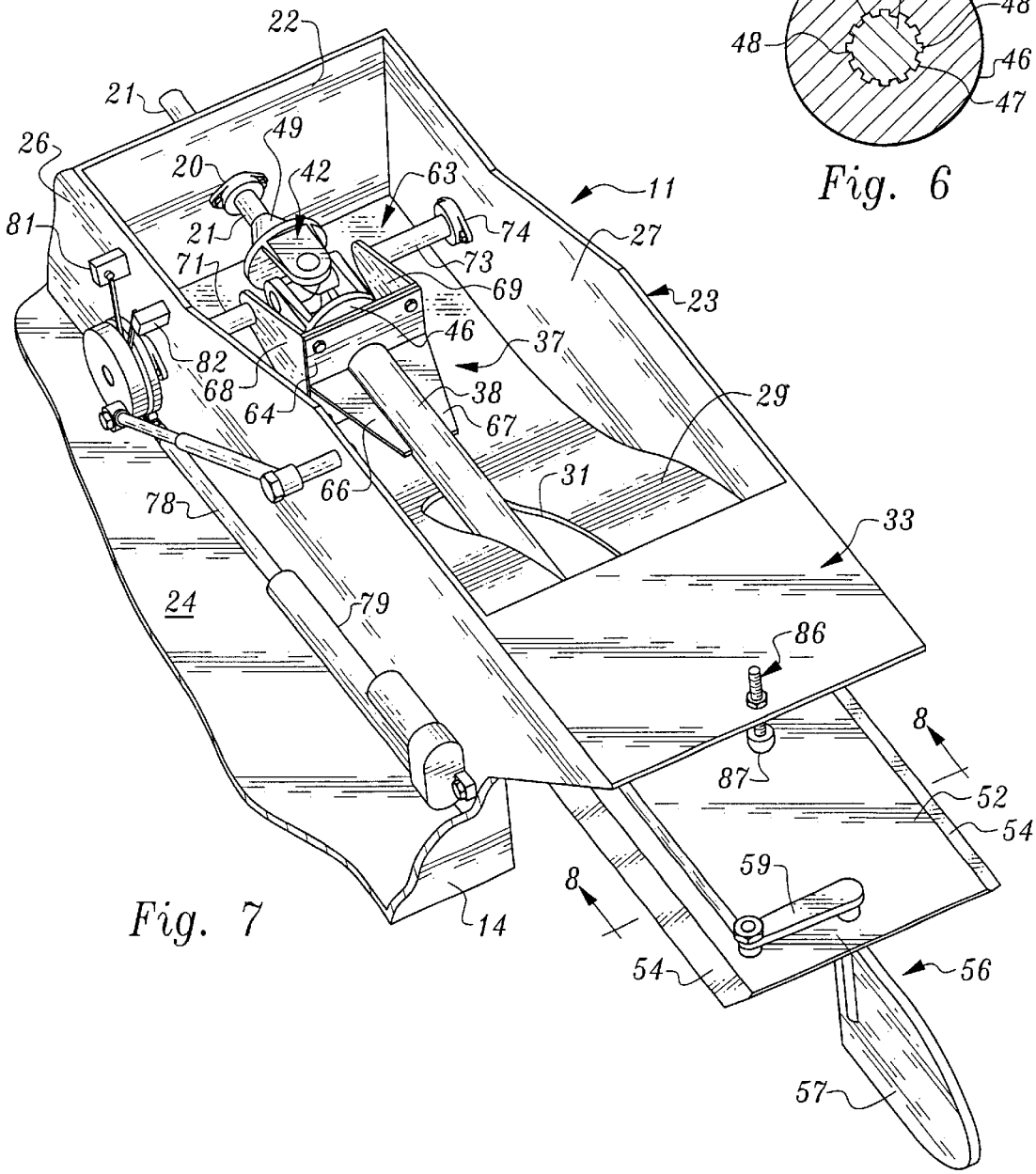
FIG. 7 is a fragmentary, perspective view of the stern tunnel and the propeller drive shaft sub-assembly.
Figure 8:
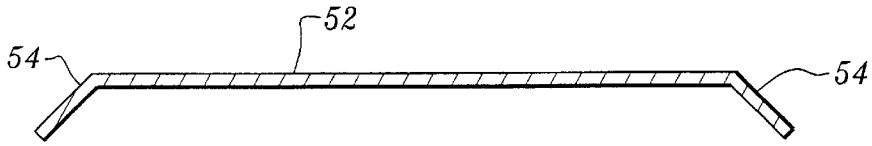
FIG. 8 is a cross-sectional view of the propeller cavitation plate, taken on the line 8—8 in FIG. 7.

Universal joint 42 has a rear circular plate 46, provided with a female spline 47. The forward end 41 of drive shaft 39 includes a male spline portion 48 which fits into female spline 47. (See, FIGS. 5 and 6). This splined coupling between drive shaft 39 and universal joint 42 allows a degree of relative fore and aft movement between these elements while maintaining positive torque drive for the propeller 44. As shown in FIG. 5, the forward end 49 of universal joint 42 is connected to the engine drive shaft 21.

A deflector skag 51 depends from the lowermost portion of the drive shaft housing 38. The lower end of skag 51 extends to a region forward from and lower than the lower blade ends of the propeller 44. As will be discussed in more detail herein, deflector skag is effective both to protect the propeller and to produce upward forces sufficient to rotate the propeller drive sub-assembly upwardly, when rocks or other debris is encountered.

The propeller drive sub-assembly also includes an anti-cavitation plate 52, mounted to the drive shaft housing 38 by means of a pair of vertical support arms 53. Opposing lateral edges of anti-cavitation plate 52 are provided with edge flares 54, extending outwardly and inclined downwardly. Edge flares 54 provide a degree of additional containment for the turbulence created by the propeller 44, thereby reducing propeller-induced cavitation.

A steering mechanism 56 is mounted on the rearmost portion of the anti-cavitation plate 52. The steering mechanism 56 includes a rudder 57 positioned rearwardly from the propeller 44. The rudder 57 is maintained in vertical relation for rotation about a vertical axis by means of a rudder support shaft 58. A lever arm 59 has one end attached to the upper end of support shaft 58. The other end of lever arm 59 is attached to a steering linkage cable 61 of the boat. Although not shown in the drawings, cable 61 extends forwardly to interconnect to steering wheel 18.

An intermediate portion 62 of the drive shaft housing 38 passes through the previously mentioned elongated slot 31, located in the bottom plate 29 of the stern tunnel. The slot is sized and configured to accommodate upward and downward excursions of the drive shaft housing 38 through a vertical plane. (See, for example, FIGS. 9 and 11).

The forward end 37 of the propeller drive sub-assembly 36 is provided with a suspension yoke, generally designated by the numeral 63. Yoke 63 comprises an end plate 64, opposing and rearwardly extending gussets 66 and 67, and opposing and forwardly extending shaft plates 68 and 69. A yoke control shaft 71 extends laterally from plate 68 through a bearing 72 mounted on first side wall 26. A yoke support shaft 73, axially coincident with control shaft 71, extends laterally from plate 69 to a bearing 74 mounted on second side wall 27. Propeller drive sub-assembly 36 is thereby pivotally suspended within the stern tunnel 23, for rotation about the common axis of control shaft 71 and support shaft 73.

The yoke control shaft 71 passes through bearing 72 to the exterior of stern tunnel 23. A sprocket 76 is located on the exterior end of the control shaft 71. A chain 77 has one end trained around a lower portion of the sprocket 76. The other end of the chain is connected to the translatable shaft 78 of an electric screw-drive actuator 79. When the shaft 78 of the actuator 79 is withdrawn, the sprocket 76 and the control shaft 71 are rotated counter-clockwise, effectively raising the propeller 44. When the shaft 78 of the actuator 79 is extended, gravity effects rotation of the propeller drive sub-assembly downwardly, thereby lowering the propeller.

Electro-mechanical limit stop switches 81 and 82, are wired-in series with the power circuit feeding actuator 79. The limit stop switches are normally closed, so power will be provided to the actuator 79 unless one or the other of the switches is tripped. For that purpose, first trip rod 83 and second trip rod 84 are provided. In the event that the propeller 44 is lowered to its lowermost position (See, FIG. 9), sprocket 76 is rotated to an extreme clockwise limit, in which second trip rod 84 triggers limit stop switch 82, disabling actuator 79 (See, FIG. 10). And, in the event that propeller 44 is raised to its uppermost position (See, FIG. 11), sprocket 76 is rotated to an extreme counter-clockwise position, in which first trip rod 83 triggers limit stop switch 81 (See, FIG. 12).

Figures 9, 10, 11, 12:
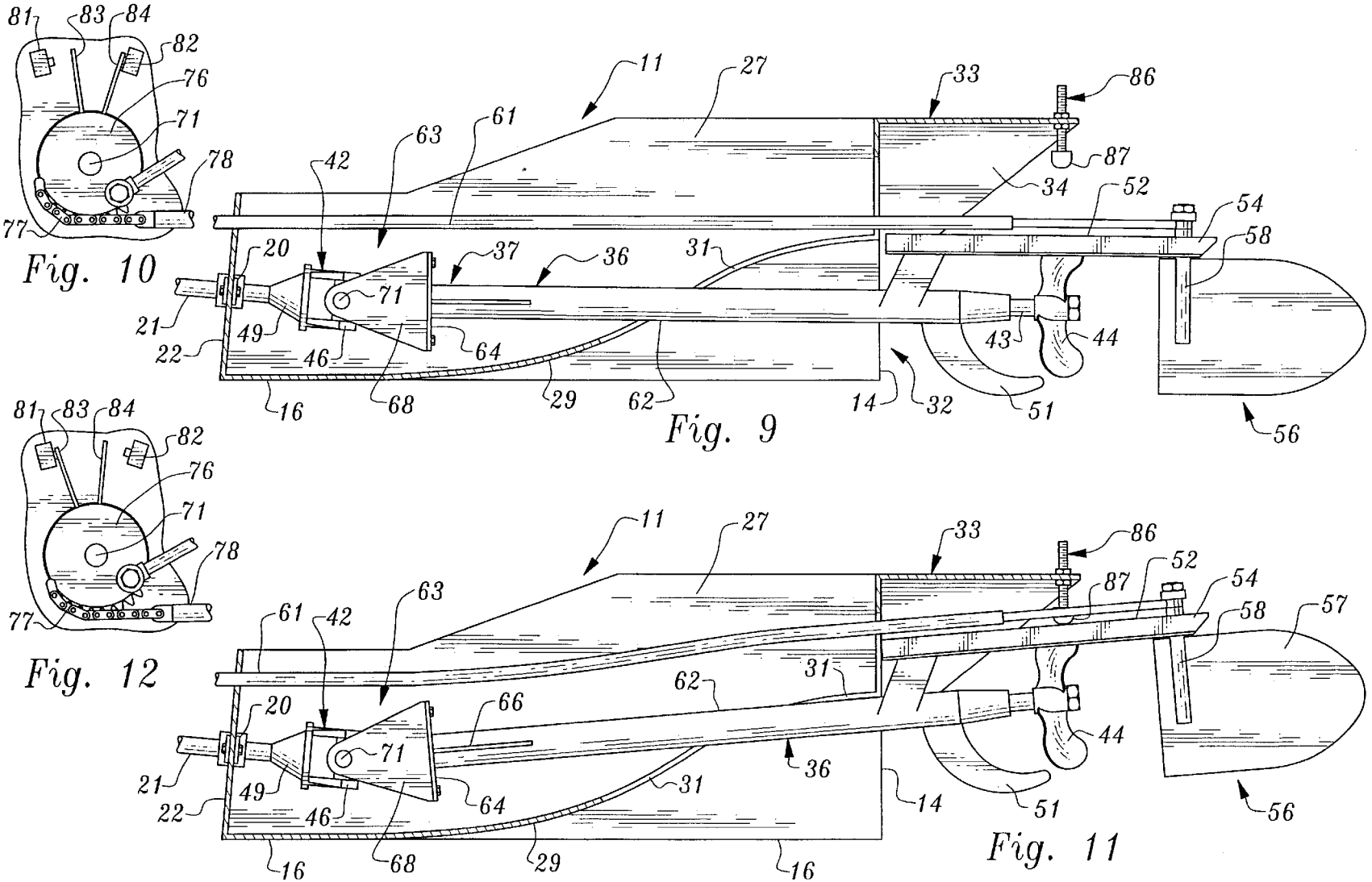
FIG. 9 is a longitudinal, cross-sectional view taken through the stern tunnel, showing the propeller drive shaft sub-assembly in a fully lowered position.
FIG. 10 is a detail inset view showing the relationship of the sprocket on the exterior end of the control shaft, the screw actuator chain, and the limit switch assembly, with the propeller drive shaft sub-assembly in a fully lowered position.
FIG. 11 is a view as in FIG. 9, but showing the propeller drive shaft sub-assembly in a fully raised position.
FIG. 12 is a view as in FIG. 10, but showing the propeller drive shaft sub-assembly in a fully raised position.
Figure 13:
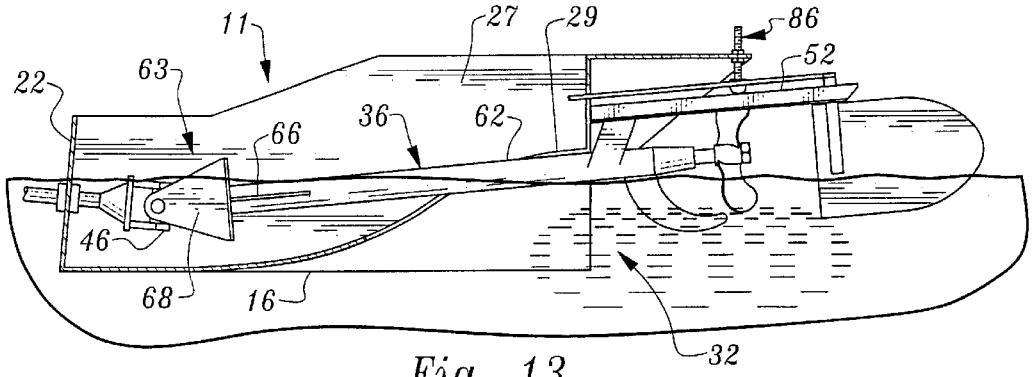
FIG. 13 is a longitudinal, cross-sectional view taken through the stern tunnel, with the boat at rest in the water, showing the propeller drive shaft sub-assembly in a predetermined, fully raised position.
Figure 14:
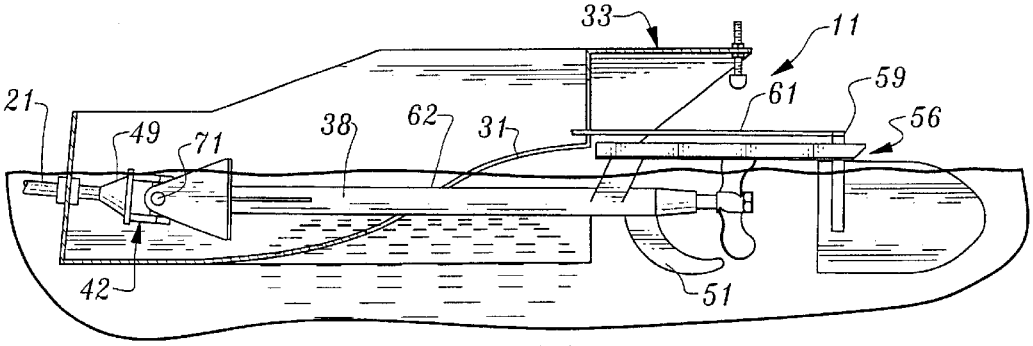
FIG. 14 is a view as in FIG. 13, but showing the propeller drive shaft sub-assembly after it is allowed to rotate under the force of gravity, into a fully lowered position.
Figure 15:
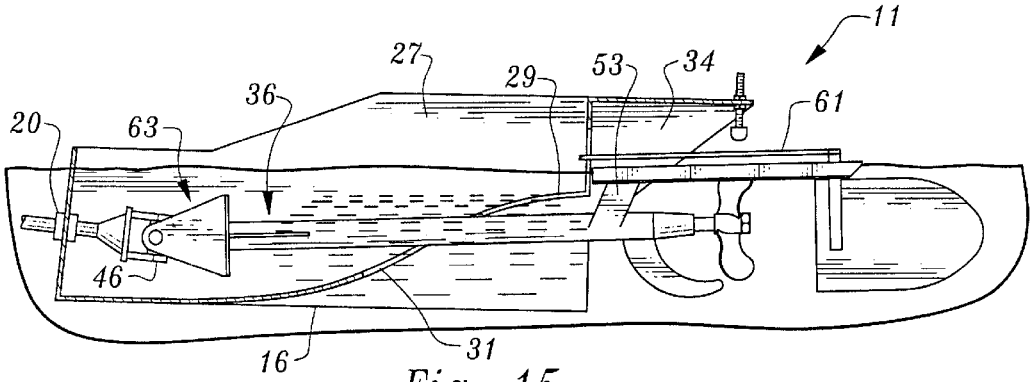
FIG. 15 is a view as in FIG. 14, but with the boat underway at a moderate speed, the stern tilting downwardly and the propeller drive shaft sub-assembly free-floating upwardly relative to stern tunnel, into an intermediate position.
Figure 16:
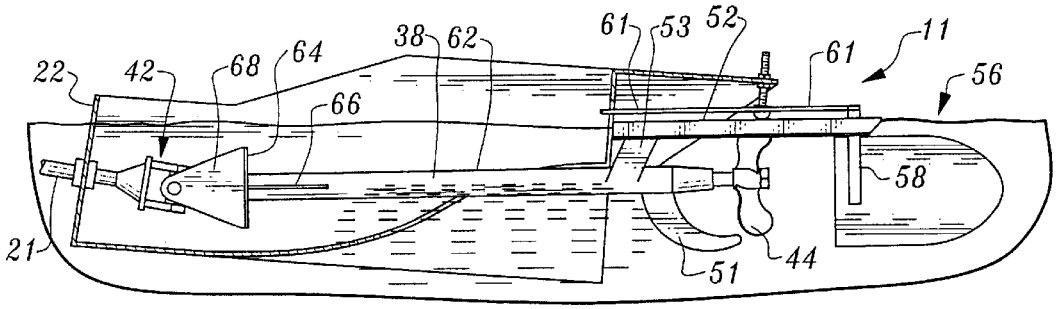
FIG. 16 is a view as in FIG. 15, but with the boat underway at a higher speed, the stern tilting farther downwardly and the propeller drive shaft sub-assembly free-floating farther upwardly relative to stern tunnel, into a fully raised position.

A mechanical limit stop 86 is also provided, depending from the underside of tunnel hood 33. Limit stop 86 is vertically adjustable, and includes a bumper 87 on its lower end. As shown in FIG. 11, when the upper surface of anti-cavitation plate 52 comes into contact with bumper 87, further upward rotation of propeller drive sub-assembly 36 is prevented.

In use, the propeller drive 11 has a number of different operational modes and different dynamic adjustments which can be made within those operational modes. For example, as described above, when the boat is at rest, the depth of the propeller 44 maybe maybe manually pre-determined by the user to any elevation from fully lowered to fully raised, or anywhere in between. This depth adjustment for the propeller is made using the electric screw-drive actuator 79. Typically, the depth of the propeller will be set anywhere from a low to an intermediate position, when the boat is departing from an at rest condition. It is not desirable to have the propeller in a fully raised position when initially departing, as the propeller is out or nearly out of the water, and will be ineffectual in providing drive to the boat.

However, it may be that once underway, the boat encounters quite shallow water where the deflector skag 51 could hit bottom. In that event, the user simply activates the electric screw-drive actuator 79, retracting the translatable shaft 78. The sprocket 76 and the control shaft 71 are thereby rotated counter-clockwise, raising the propeller 44 to a safe elevation. While this may reduce the efficiency of the drive-system somewhat, it does enable the boat to continue underway. Then, when the boat returns to deeper water, the user again activates the actuator 79, but this time in the opposite direction. By translating the shaft 78 to an extended position, gravitational forces act to lower the propeller into the deeper water.

It should also be noted that depending upon the speed of the boat and the load of persons and items in the boat, the relative position of the propeller drive sub-assembly 36 within the stern tunnel 23 is variable. For example, FIGS. 9 and 11 represent extreme lowered and raised positions, respectively, for the assembly 36. With a heavier payload in the boat and a greater forward speed, assembly 36 will have a tendency to move upwardly, to that position shown in FIG. 11. And, with a lighter payload and a lesser forward speed, assembly 36 will tend to assume a relatively lower position, as shown in FIG. 9.

FIGS. 9 and 11 also illustrate the co-operative relationship between the bottom plate 29 and the anti-cavitation plate 52. Through experimentation, it has been determined that be extending the trailing end of the bottom plate 29 so that it terminates in the vicinity of the leading edge of the anti-cavitation plate 52, the best performance of the propeller drive 11 is obtained. It is believed that when underway, the bottom plate 29 delivers a substantial flow of water below the anti-cavitation plate directly into the propeller 44. This enhanced water flow pattern, coupled with the controlling effects of the anti-cavitation plate 52, ensures that the propeller will provide positive drive for the boat even under marginal water depth conditions.

It is believed, then, that I have disclosed an improved inboard propeller drive system for shallow draft boats, utilizing a pivotally mounted propeller drive sub-assembly within a stern tunnel, which is both manually and dynamically adjustable in depth to accommodate a wide variety of operational conditions.

What is claimed is:

1. An inboard propeller drive system for boats, comprising:

a. an elongated stern tunnel, said tunnel having opposing side walls, a forward end wall, an upper cover, an upwardly and rearwardly inclined bottom plate, and an open rearward end portion;

b. a propeller drive shaft sub-assembly, said sub-assembly including a drive shaft housing, a drive shaft extending through said housing, said drive shaft having a forward end and a rearward end, a propeller mounted on said rearward end of said shaft, an anti-cavitation plate mounted to said drive shaft housing and extending above said propeller, and a steering mechanism mounted to said anti-cavitation plate, said steering mechanism including a rudder, and, c. means for pivotally suspending a forward end of said drive shaft sub-assembly within a forward end of said housing.

2. A drive system as in claim 1 in which said means for pivotally suspending said front end of said sub-assembly comprises a yoke mounted on said forward end of said sub-assembly, said yoke including laterally extending shaft means, said shaft means engaging respective bearings mounted on a respective one of said side walls.

3. A drive system as in claim 2 in which said shaft means includes a control shaft extending from said yoke through a respective said bearing, to the exterior of said tunnel.

4. A drive system as in claim 3 including a sprocket on an exterior end of said control shaft, a chain having one end trained around at least a portion of said sprocket, and actuator means connected to the other end of said chain.

5. A drive system as in claim 4 in which said actuator means comprises an electrical motor and a screw drive adapted selectively to pull upon or let out said chain, thereby effecting raising or lowering of a rear end of said propeller drive shaft sub-assembly to a predetermined position.

6. A drive system as in claim 5 including a two-way reversible switch for actuating said electrical motor in a selected direction, and further including limit switch means at a clockwise rotational extreme and at a counter-clockwise rotational extreme of said sprocket, said limit switch means being series connected between said electrical motor and said reversible switch.

7. A drive system as in claim 1 including an inboard engine exterior from said tunnel housing, and further including a universal joint interconnecting said forward end of the drive shaft with an output shaft of said inboard engine.

8. A drive system as in claim 1 further including a boat having a bow end and a stern end, the longitudinal axis of said stern tunnel being aligned with a longitudinal axis of said boat, said open rearward end portion being positioned at said stern end, and said inboard engine being located forward from said forward end of said stern tunnel.

9. A drive system as in claim 8 in which said inboard engine is either air cooled or self-contained water cooled.

10. A drive system as in claim 3 including damping means having a movable portion interconnected to an exterior end of said control shaft.

11. A drive system as in claim 10 in which said damping means comprises a pneumatic or hydraulic cylinder having a fixed end connected to said stern tunnel.

12. A drive system as in claim 1 further including a deflection skag mounted to said drive shaft housing and extending below said propeller.

13. A drive system as in claim 1 further including a stern tunnel hood extending rearwardly from said open rearward end portion.

14. A propeller driven boat, comprising:

a. an elongated boat having a bow end and a stern end, said boat including a floor;

b. an elongated stern tunnel within said floor, said tunnel having opposing side walls, a forward end wall spanning said side walls, an upper cover, an upwardly and rearwardly inclined bottom plate, and an open rearward end portion, the longitudinal axis of said stern tunnel being aligned with the longitudinal axis of said boat, and said open rearward end portion being positioned at said stern end;

c. a propeller drive shaft sub-assembly, said sub-assembly including a drive shaft housing, a drive shaft extending through said housing, said drive shaft having a forward end and a rearward end, a propeller mounted on said rearward end of said shaft, an anti-cavitation plate mounted to said drive shaft housing and extending above said propeller, and a steering mechanism mounted to said anti-cavitation plate, said steering mechanism including a rudder;

d. means for pivotally suspending a forward end of said sub-assembly within a forward end of said stern tunnel, with said drive shaft housing passing through an aperture in said bottom plate; and, e. an inboard engine located forwardly from said forward end of said stern tunnel, said engine including an output shaft passing through said forward end wall and being connected to said forward end of said drive shaft.

15. A boat as in claim 14 in which said means for pivotally suspending said front end of said sub-assembly comprises a yoke mounted on said forward end of said sub-assembly, said yoke including laterally extending shaft means, said shaft means engaging respective bearings mounted on a respective one of said side walls.

16. A boat as in claim 15 in which said shaft means includes a control shaft extending from said yoke through a respective said bearing, to the exterior of said tunnel.

17. A boat as in claim 16 including a sprocket on an exterior end of said control shaft, a chain having one end trained around at least a portion of said sprocket, and actuator means connected to the other end of said chain.

18. A boat as in claim 17 in which said actuator means comprises an electrical motor and a screw drive adapted selectively to pull upon or let out said chain, thereby effecting raising or lowering of a rear end of said propeller drive shaft sub-assembly to a predetermined position.

19. A boat as in claim 18 including a two-way reversible switch for actuating said electrical motor in a selected direction, and further including limit switch means at a clockwise rotational extreme and at a counter-clockwise rotational extreme of said sprocket, said limit switch means being series connected between said electrical motor and said reversible switch.

20. A boat as in claim 14 in which said inboard engine is either air cooled or self-contained water cooled.

21. A boat as in claim 14 further including a deflection skag mounted to said drive shaft housing and extending below said propeller.

22. A boat as in claim 14 further including a stern tunnel hood extending rearwardly from said open rearward end portion, said tunnel hood having a forward end attached to said stern end.

* * * * *